US009590347B2

(12) United States Patent
Zhao et al.

(10) Patent No.: US 9,590,347 B2
(45) Date of Patent: Mar. 7, 2017

(54) RECEPTACLE CONNECTOR HAVING IMPROVED INSULATIVE HOUSING

(71) Applicant: FOXCONN INTERCONNECT TECHNOLOGY LIMITED, Grand Cayman (KY)

(72) Inventors: Jun Zhao, HuaiAn (CN); Jing-Jie Guo, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/942,959

(22) Filed: Nov. 16, 2015

(65) Prior Publication Data

US 2016/0141805 A1 May 19, 2016

(30) Foreign Application Priority Data

Nov. 14, 2014 (CN) ..... 2014 2 0677010

(51) Int. Cl.

| | |
|---|---|
| ***H01R 13/648*** | (2006.01) |
| ***H01R 13/504*** | (2006.01) |
| ***H01R 13/6585*** | (2011.01) |
| ***H01R 13/6594*** | (2011.01) |
| *H01R 24/60* | (2011.01) |
| *H01R 107/00* | (2006.01) |

(52) U.S. Cl.

CPC ..... *H01R 13/504* (2013.01); *H01R 13/6585* (2013.01); *H01R 13/6594* (2013.01); *H01R 24/60* (2013.01); *H01R 2107/00* (2013.01)

(58) Field of Classification Search

CPC H01R 13/648; H01R 13/6581; H01R 13/658; H01R 13/6585; H01R 13/6586; H01R 13/6593

USPC ..... 439/607.01, 607.05, 676, 660, 607.4

See application file for complete search history.

(56) References Cited

U.S. PATENT DOCUMENTS 8,475,216 B2 * 7/2013 Tung ..... H01R 13/506 439/607.4

9,022,800 B2 * 5/2015 Yang ..... H01R 13/6581 439/487

(Continued)

FOREIGN PATENT DOCUMENTS

CN 203871583 10/2014

*Primary Examiner* — Hae Moon Hyeon

(74) *Attorney, Agent, or Firm* — Wei Te Chung; Ming Chieh Chang

(57) ABSTRACT

A receptacle connector mounted upon a printed circuit board and adapted for mating with a plug connector, includes an insulative housing, a number of terminals disposed in the insulative housing, a metal sheet, and a shielding shell attached to the housing. The housing includes a first insulative housing defining a first tongue portion extending forwardly, a second insulative housing defining a second tongue portion extending forwardly, and a third insulative housing defining a third tongue portion extending forwardly. The terminals include a number of first contacts and second contacts. The third insulative housing is over-molded with the first insulative housing, the metal sheet, and the second insulative housing to enclose the first tongue portion and the second tongue portion into the third tongue portion and the first contacts and the second contacts respectively exposed on an upper and a bottom surface of the third tongue portion.

16 Claims, 8 Drawing Sheets

(56) References Cited

U.S. PATENT DOCUMENTS

| | | | | |
|---|---|---|---|---|
| 9,093,784 | B2 * | 7/2015 | Zhang | H01R 13/6272 |
| 9,214,766 | B1 * | 12/2015 | Yu | H01R 13/6585 |
| 2015/0222059 | A1 | 8/2015 | Little et al. | |
| 2015/0244118 | A1 | 8/2015 | Lin et al. | |
| 2015/0311636 | A1 | 10/2015 | Chang et al. | |
| 2016/0111821 | A1 * | 4/2016 | Lan | H01R 13/646<br>439/607.01 |

* cited by examiner

RECEPTACLE CONNECTOR HAVING IMPROVED INSULATIVE HOUSING

BACKGROUND OF THE INVENTION

1. Field of the Invention

The present invention relates to a receptacle connector, and more particularly to a receptacle connector having improved insulative housing.

2. Description of Related Art

The Universal Serial Bus and USB connectors are well known in the art. China Patent No. 203871583 discloses a receptacle connector including an insulative housing, a number of contacts, a metal case engaged with the insulative housing, and a shielding shell enclosing the insulative housing. The insulative housing includes a first base, a second base, and a third housing. The first base and the second base shape like cuboids. The third housing defines a third base and a tongue portion extending forwardly from the third base. The contacts include a number of first contacts retained in the first base and a number of second contacts retained in the second base. Each of the first contacts has a first contacting portion extending beyond the first base and each of the second contacts has a second contacting portion extending beyond the second base. The metal case includes a number of affixed arms received in grooves of the second base. The contacting portion is prone to damage or wrongly inserted into the third housing during assembling, thus decreasing yield rate and increasing man-hour and cost.

Hence, a new and simple receptacle connector is desired.

SUMMARY OF THE INVENTION

Accordingly, the object of the present invention is to provide a receptacle connector mounting upon a printed circuit board and adapted for mating with a plug connector, comprising: an insulative housing comprising a first insulative housing defining a first tongue portion forwardly extending, a second insulative housing defining a second tongue portion forwardly extending, and a third insulative housing defining a third tongue portion forwardly extending; a plurality of terminals disposed in the insulative housing and having a plurality of first contacts exposed to the first tongue portion and a plurality of second contacts exposed to the second tongue portion, each first contact defining a first contacting portion, each second contact defining a second contacting portion; a metal sheet sandwiched by the first insulative housing and the second insulative housing; and a shielding shell attached to the housing to define a mating cavity in which mating tongue is disposed, wherein the third insulative housing is over-molded with the first insulative housing, the metal sheet, and the second insulative housing to enclose the first tongue portion and the second tongue portion into the third tongue portion and the first contacts and the second contacts respectively exposed on an upper and a bottom surface of the third tongue portion.

Other objects, advantages and novel features of the invention will become more apparent from the following detailed description when taken in conjunction with the accompanying drawings.

DETAILED DESCRIPTION OF THE PREFERRED EMBODIMENT

Figure 1:
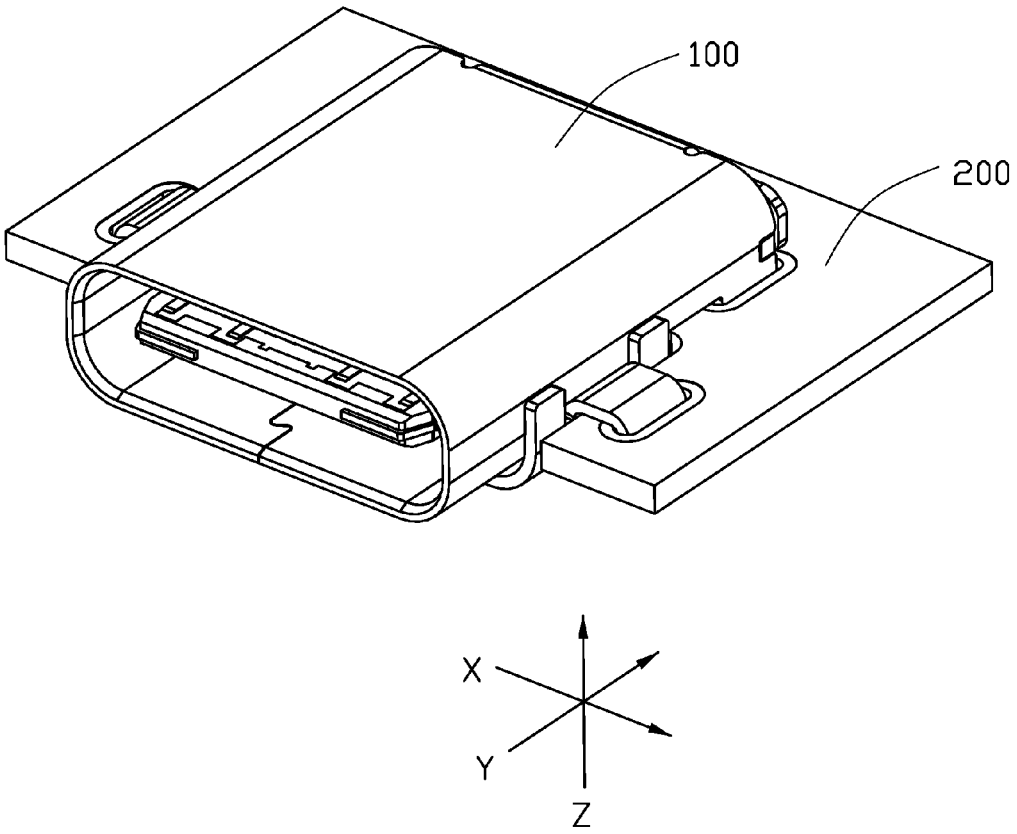
FIG. 1 is a perspective view of a receptacle connector mounted upon a printed circuit board in a sink manner.
Figure 2:
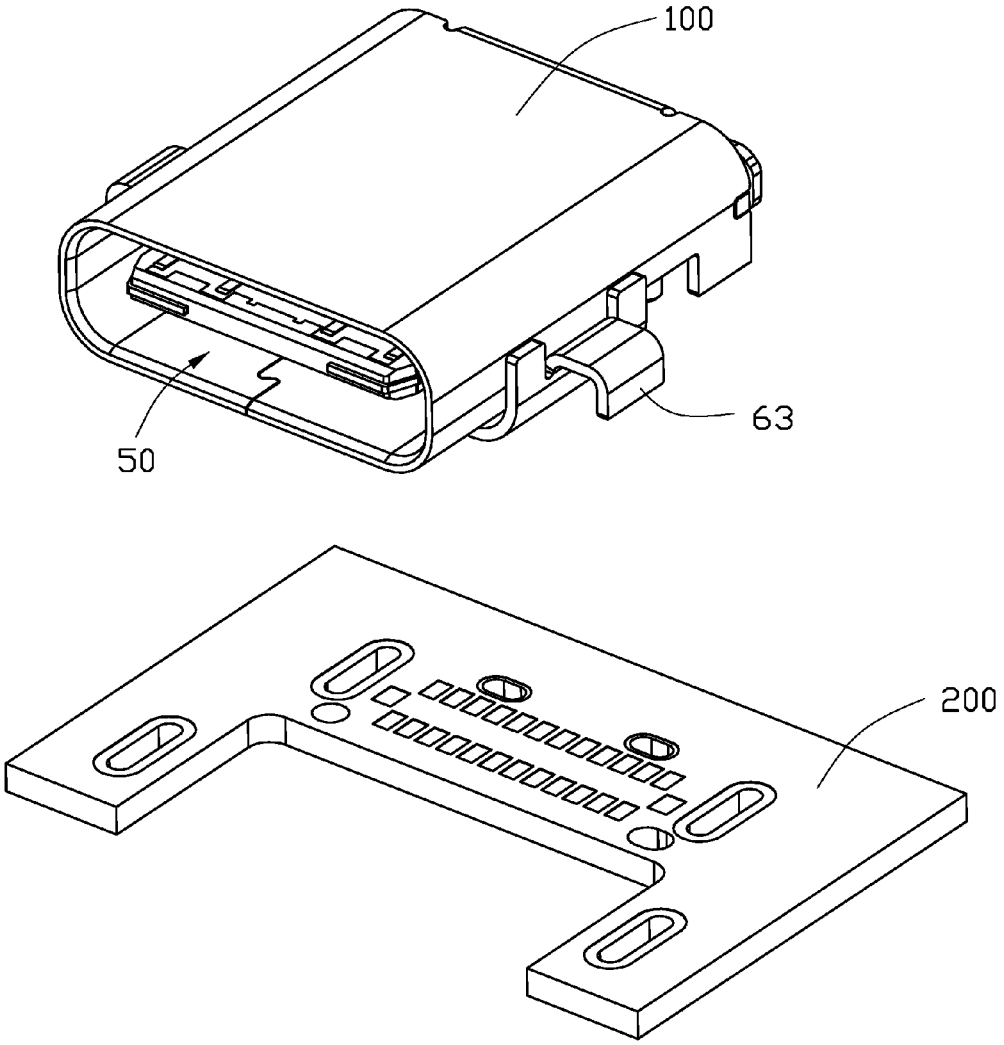
FIG. 2 is a perspective view of the receptacle connector separated with the printed circuit board.
Figure 3:
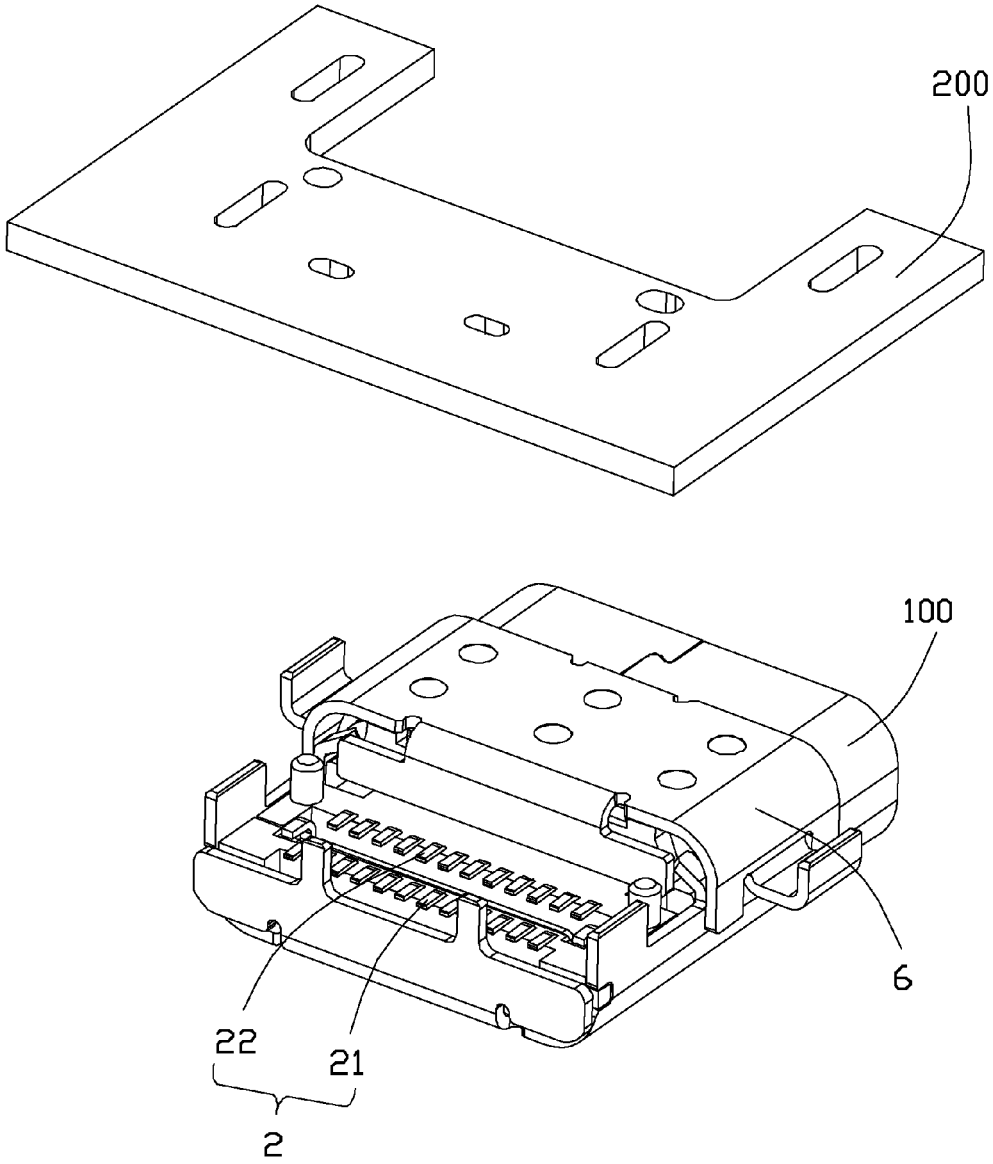
FIG. 3 is another perspective view of the receptacle connector separated with the printed circuit board of FIG. 2.
Figure 4:
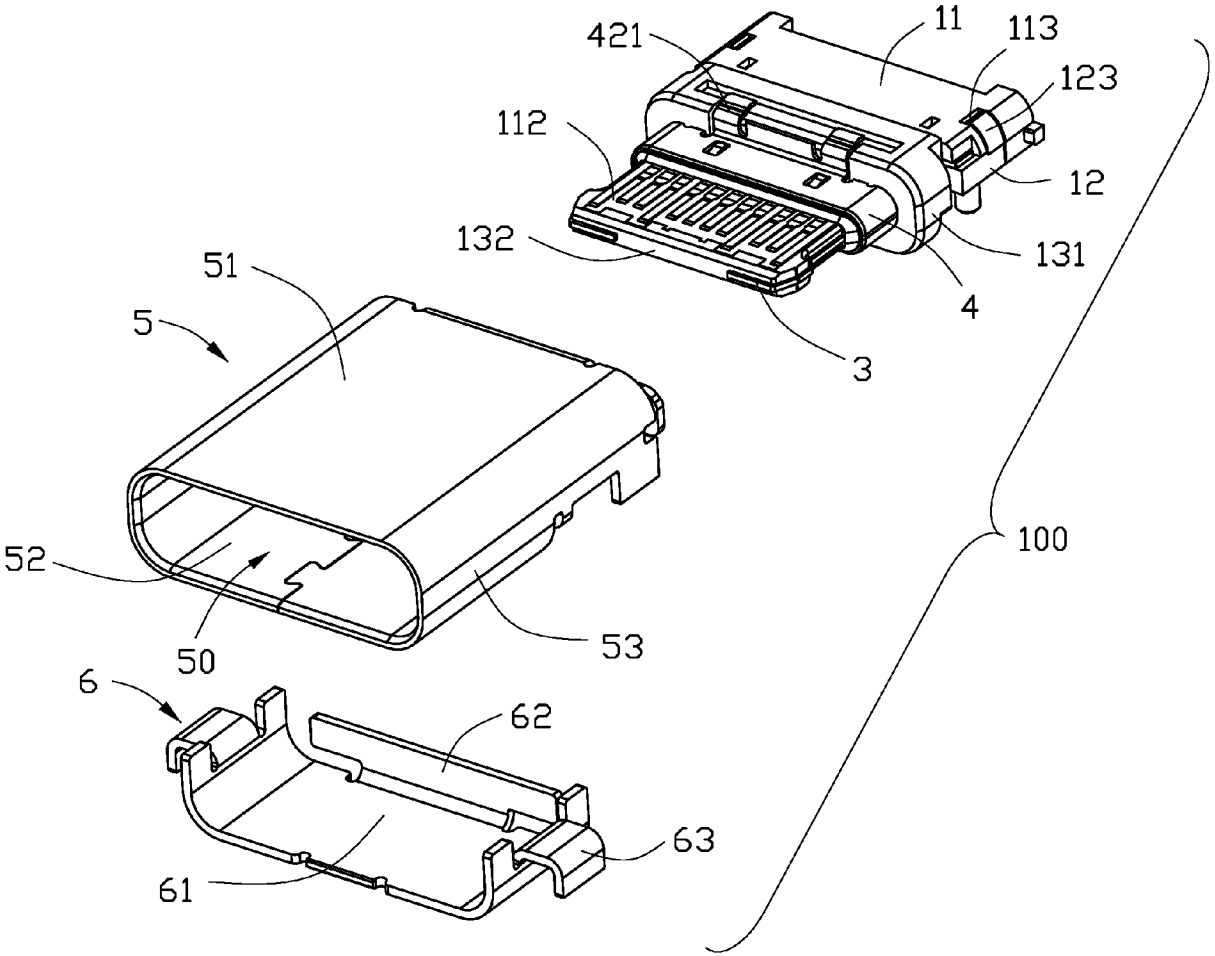
FIG. 4 is a perspective, partly exploded view of the receptacle connector.

Reference will now be made in detail to the preferred embodiment of the present invention.

FIGS. 1-8 show a receptacle connector 100 mounted upon a printed circuit board 200 in a sink manner and cooperated with a plug connector. The receptacle connector 100 includes an insulative housing 1, a number of terminals 2 and a metal sheet 3 retained in the insulative housing 1, a collar shell 4 enclosing the insulative housing 1, a shielding shell 5 formed with a mating cavity to receive the insulative housing 1, and a metal shell 6 attached to the shielding shell 5.

Figure 5:
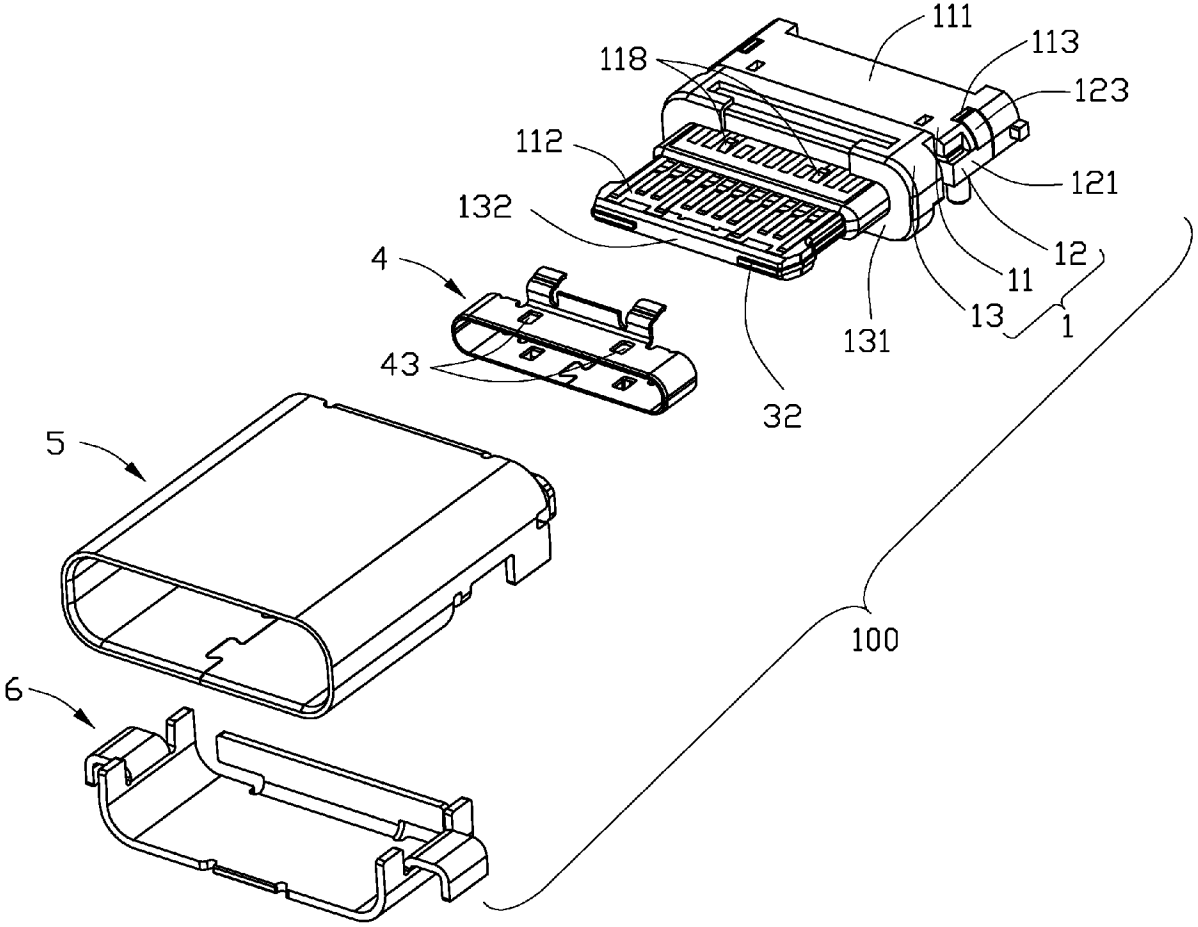
FIG. 5 is a further perspective, partly exploded view of the receptacle connector of FIG. 4.
Figure 6:
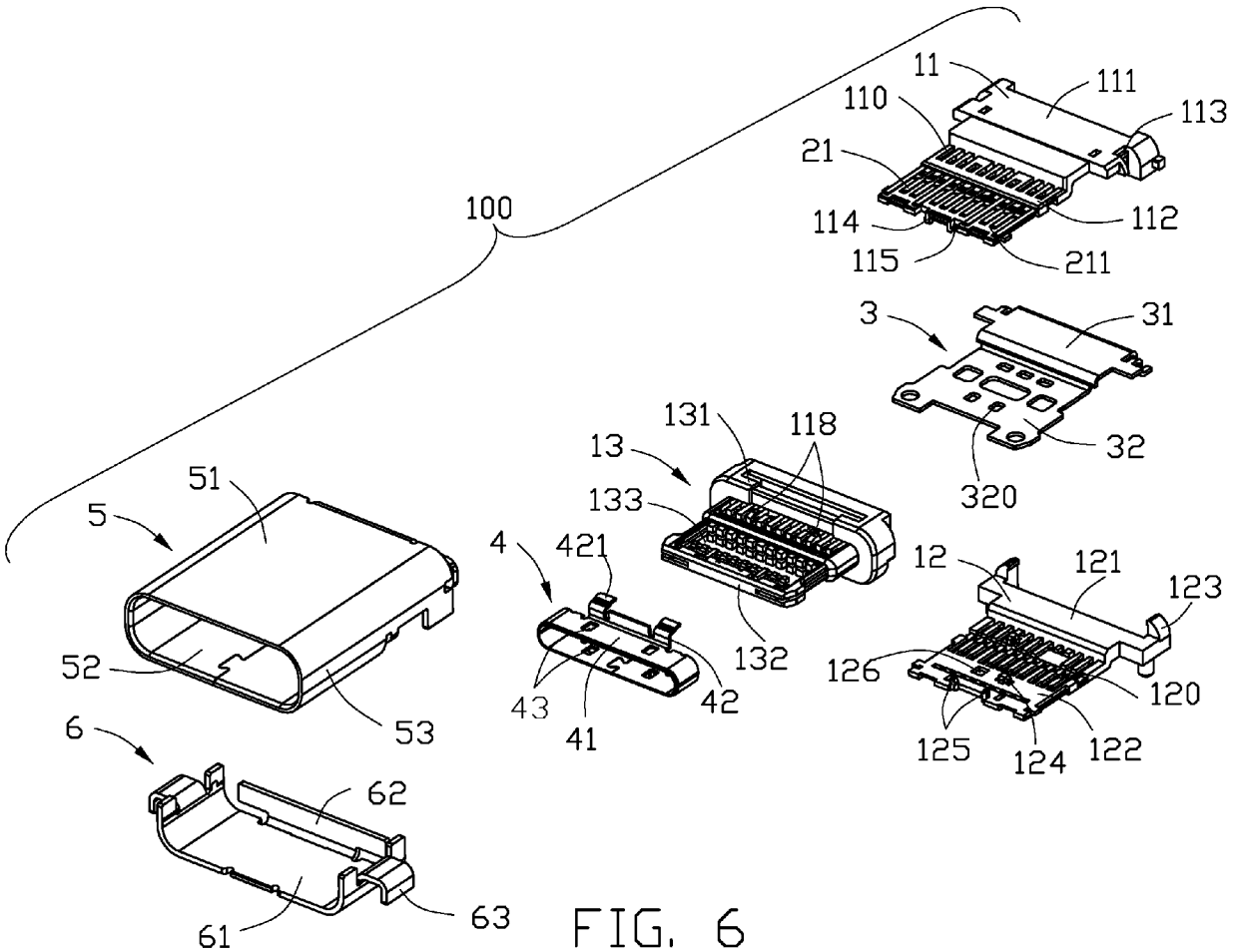
FIG. 6 is a perspective, exploded view of the receptacle connector.
Figure 7:
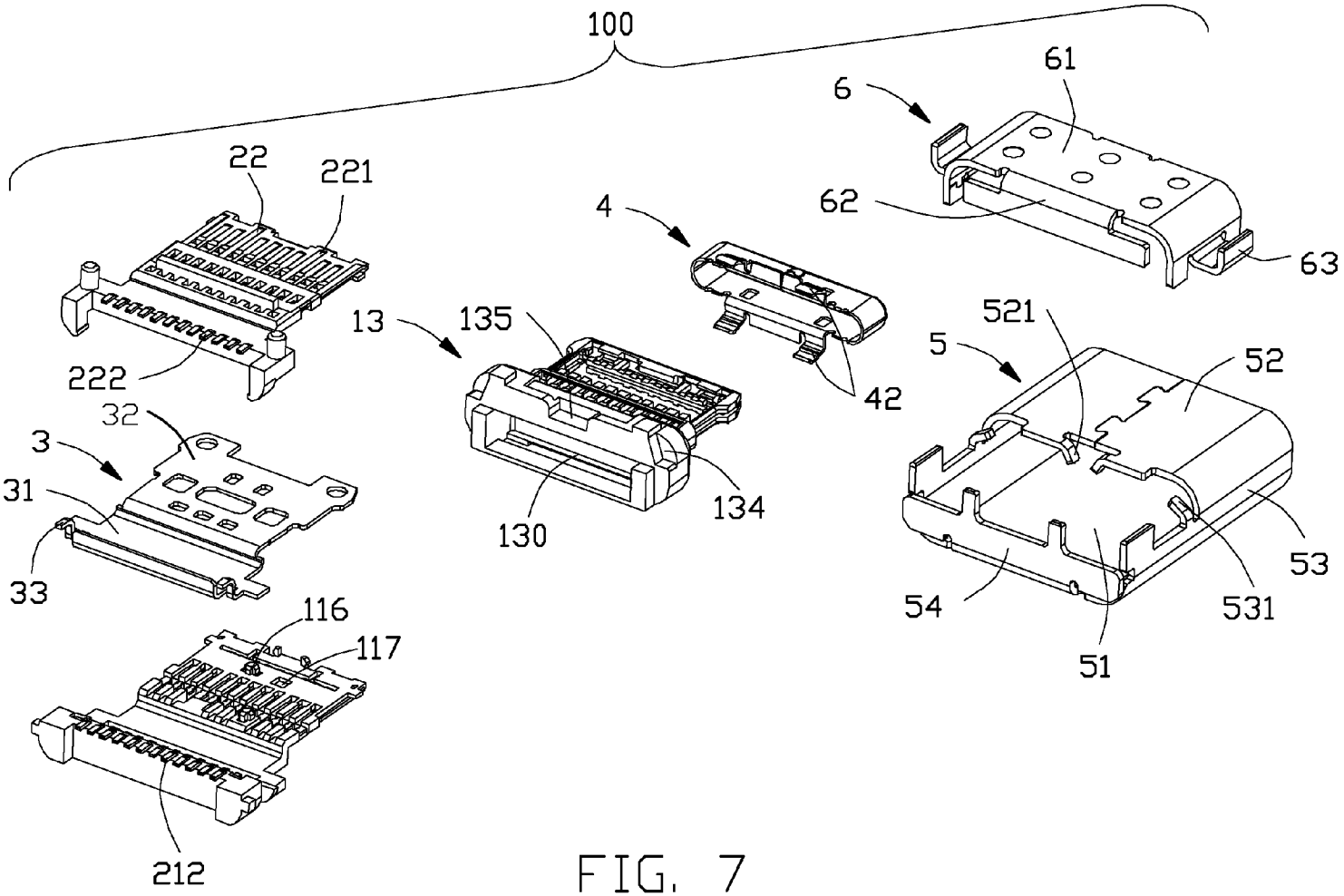
FIG. 7 is another perspective, exploded view of the receptacle connector of FIG. 6.

Referring to FIGS. 5-7, the insulative housing 1 includes a first insulative housing 11, a second insulative housing 12, and a third insulative housing 13. The first insulative housing 11 includes a first base portion 111 and a first tongue portion 112 extending forwardly from the first base portion 111 along a front-to-back direction Y. The first base portion 111 defines a pair of depression 113 located at two sides thereof in a transverse direction X perpendicular to the front-to-back direction Y. The first tongue portion 112 has a pair of first ribs 114 extending downwardly from a front end and a pair of gaps 115 located beside the first ribs 114. The first tongue portion 112 defines a number of first receiving grooves 110 extending in an insertion direction or the front-to-back direction Y, a number of first bulges 116 shaping in crisscross and located at a bottom surface, and a number of first slots 117 beside the first bulge 116. The second insulative housing 12 includes a second base portion 121 and a second tongue portion 122 extending forwardly from the second base portion 121. The second base portion 121 has a pair of projections 123 extending upwardly and locking the depression 113 of the first insulative housing 11. The second tongue portion 122 includes a number of second receiving grooves 120 extending in an insertion direction, a number of second bulges 124 shaping in crisscross and located at a top surface, a number of second slots 126 beside the second bulge 124, and a pair of second ribs 125 extending upwardly in a front end. The second ribs 125 are resisted against the first ribs 114 through the gaps 115 to lock the first insulative housing 11 with the second insulative housing 12. The third insulative housing 13 includes a third base portion 131 and a third tongue portion 132 extending forwardly from the third base portion 131. The third tongue portion 132 defines a hollow part 133. The third base portion 131 defines an insertion entrance 130 in a rear end, a pair of concave portion 134 located at two sides, and a sunken portion 135 in a middle. Notably, the first tongue portion 112, the second tongue portion 122 and the third tongue portion 132 commonly form a tongue assembly for coupling to the plug connector.

The terminals 2 include a number of first contacts 21 integrally carried by the first tongue portion 112 to form a first terminal module, and a number of second contacts 22 integrally carried by the second tongue portion 122 to form a second terminal module. The first contacts 21 and the second contacts 22 extend in an insertion direction and respectively include four power contacts located forwardly and eight signal contacts located backwardly. The two power contacts in the middle are used to provide electric source and the other two are used for electrical grounding. The eight signal contacts include four super-speed differential contacts located at two sides, two low-speed differential contacts located in the middle, and a pair of controlling contacts. Each of the first contacts 21 is associated with a respective one of the second contacts 22 and is positioned in reverse symmetry with respect to the second contacts 22.

Each of the first contacts 21 includes a first contacting portion 211 disposed in an upper surface of the first tongue portion 112 and a first soldering portion 212 extending from a back end of the first base portion 111. Each of the second contacts 22 includes a second contacting portion 221 disposed in a bottom surface of the second tongue portion 122 and a second soldering portion 222 extending from a back end of the second base portion 121. The first contacts 21 and the second contacts 22 are positioned e to have 180 degree symmetry such that the corresponding plug connector can be inserted and operatively coupled to the receptacle connector 100 in either of two orientations. The first soldering portions 212 and the second soldering portions 222 are located at a same plane and configured in two rows.

The metal sheet or metallic shielding plate 3 shaping like a panel includes a main portion 31 sandwiched between the first base portion 111 and the second base portion 121, a supporting portion 32 sandwiched between the first tongue portion 112 and the second tongue portion 122 in a vertical direction Z perpendicular to both the front-to-back direction Y and the transverse direction X, and soldering legs 33. As an alignment means in the vertical direction, the supporting portion 32 is formed with a number of apertures 320 to receive the first bulges 116 of the first tongue portion 112 in the second slots 126 of the second tongue portion 12 therethrough, and to receive the second bulges 124 of the second tongue portion 12 received in the first slots 117 of the first tongue portion 11 therethrough. The soldering leg 33, the first soldering portion 212, and the second soldering portion 222 are exposed from the insulative housing 1 to be soldered into the printed circuit board 200 together.

Figure 8:
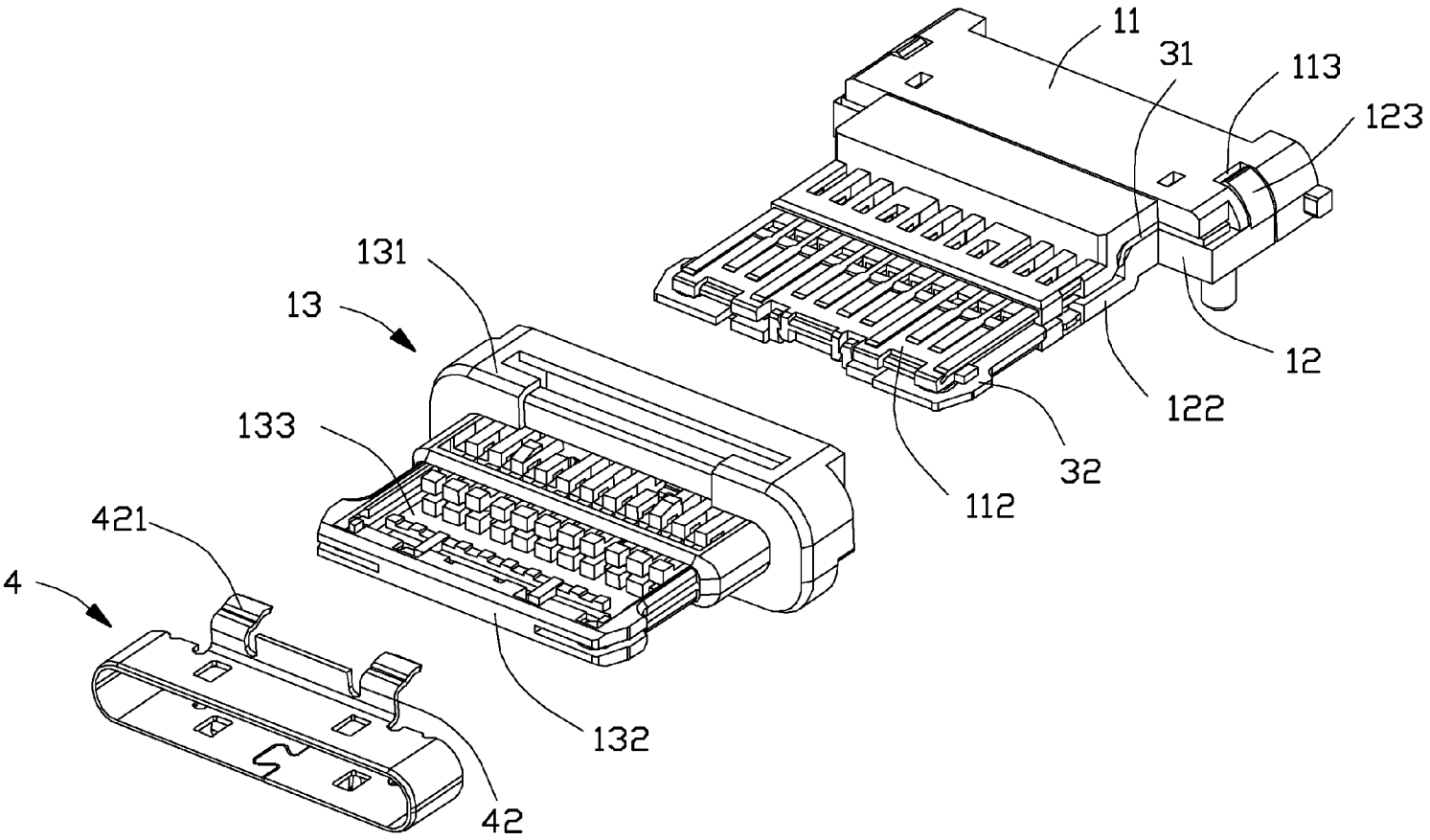
FIG. 8 is another perspective, partly exploded view of the receptacle connector.

Referring to FIGS. 6-8, the (inner metallic) collar shell 4 includes an annular portion 41, and a number of affixed portion 42 extending from the annular portion 41. A pair of the affixed portion 42 are bent upwardly then extending backwardly from a top end of the annular portion 41 and the other pair of the affixed portion 42 are bent downwardly then extending backwardly from a bottom end of the annular portion 41. Each of the affixed portions 42 has an elastic portion 421 to engage with an upper surface and a bottom surface of the third base portion 131 to resiliently resist the plug connector. In this embodiment, the collar shell 4 forms two pairs of through holes 43 to respectively receive the corresponding wedge projections 118 of the first insulative housing and the second insulative housing around root sections of the corresponding tongue portions for securing therebetween after the collar shell 4 assembled to the assembled housings along the front-to-back direction.

The shielding shell 5 forms a mating cavity 50 and includes a top wall 51 and a bottom wall 52 located oppositely, a pair of side walls 53 connected with the top wall 51 and the bottom wall 52, and a rear wall 54 separated with the bottom wall 52. The bottom wall 52 has a pair of first arms 521 extending upwardly and received in the sunken portions 135 of the third base portion 131, and the each side wall 53 has a second arm 531 extending downwardly and received in the concave portion 134 of the third base portion 131 to lock the insulative housing 1 with the shielding shell 5.

The metal shell 6 includes a main board 61, a rear board 62 extending downwardly from a rear end of the main board 61, and a pair of affixed legs 63. The rear board 62 shields after the third base portion 131. The affixed legs 63 are affixed to the printed circuit board 200.

The first insulative housing 11 and the second insulative housing 12 are respectively insert-molded, then assembled with the metal sheet 3 to form a sub-assembly. The third insulative housing 13 is over-molded with the sub-assembly, i.e., the combination of the first insulative housing 11, the metal sheet 3 and the second insulative housing 12, to orient the terminals 2 in a right way. The first tongue portion 112 supports the first contacting portion 211 and the second tongue portion 122 supports the second contacting portion 221 to prevent the terminals 2 damage or locating at wrong positions in over-molding process.

However, the disclosure is illustrative only, changes may be made in detail, especially in matter of shape, size, and arrangement of parts within the principles of the invention.

What is claimed is:

1. A receptacle connector comprising:

an insulative housing assembly comprising a first insulative housing defining a first tongue portion extending forwardly, a second insulative housing defining a second tongue portion extending forwardly, and a third insulative housing defining a third tongue portion extending forwardly;

a plurality of terminals disposed in the insulative housing assembly and having a plurality of first contacts exposed to the first tongue portion and a plurality of second contacts exposed to the second tongue portion, each first contact defining a first contacting portion, each second contact defining a second contacting portion;

a metal sheet sandwiched by the first insulative housing and the second insulative housing; and a shielding shell attached to the housing assembly, wherein the third insulative housing is over-molded with the first insulative housing, the metal sheet, and the second insulative housing to accommodate the first tongue portion and the second tongue portion into the third tongue portion and to expose the first contacts and the second contacts respectively on an upper and a bottom surface of the third tongue portion;

wherein a front of the first tongue portion is locked to a front of the second tongue portion;

wherein said first insulative housing has a first base portion extending rearwardly from the first tongue portion, the second insulative housing has a second base portion extending rearwardly from the second tongue portion, the third insulative housing has a third base portion extending rearwardly from the third tongue portion; and wherein the first base portion is locked to the second base portion.

2. The receptacle connector as claimed in claim 1, wherein said metal sheet has a main portion sandwiched by the first tongue portion and the second tongue portion, the third tongue portion has a hollow part, the first tongue portion, the metal sheet, and the second tongue portion are received in the third tongue portion, and the first contacts and the second contacts are exposed from the hollow part.

3. The receptacle connector as claimed in claim 2, wherein said first tongue portion has a plurality of first bulges and first slots in a bottom surface thereof and the second tongue portion has a plurality of second bulges and second slots in an upper surface thereof, the metal sheet has a plurality of apertures, the first bulges of the first tongue portion are received in the second slots of the second tongue portion through the apertures, and the second bulges of the second tongue portion are received in the first slots of the first tongue portion through the apertures.

4. The receptacle connector as claimed in claim 1, wherein said first tongue portion defines a plurality of gaps and first ribs extending downwardly, the second tongue portion defines a plurality of second ribs extending upwardly, and the second ribs are received in the gaps and resisted against by the first ribs.

5. The receptacle connector as claimed in claim 1, wherein said first base portion has a pair of depressions located at two sides thereof, the second base portion has a pair of projections located at two sides thereof received in the depressions.

6. The receptacle connector as claimed in claim 1, wherein said receptacle connector has a collar shell enclosing the insulative housing assembly, and the collar shell is attached to the third tongue portion to expose the first contacting portions and the second contacting portions.

7. The receptacle connector as claimed in claim 6, wherein said collar shell has a plurality of affixed portions extending from a top end and a bottom end thereof, each of the affixed portions has an elastic portion, and the elastic portions are engaged with an upper surface and a bottom surface of the third insulative housing.

8. The receptacle connector as claimed in claim 1, wherein the first contacts are insert-molded with the first insulative housing, and the second contacts are insert-molded with the second insulative housing.

9. A receptacle connector comprising:

a first terminal module including a plurality of first contacts integrally formed with a first insulative housing, said first contacts arranged with one another along a transverse direction while each of said first contacts extending along a front-to-back direction perpendicular to said transverse direction;

a second terminal module including a plurality of second contacts integrally formed with a second insulative housing, said second contacts arranged with one another along the transverse direction while each of said second contacts extending along the front-to-back direction;

a metallic shielding plate sandwiched between the first insulative housing and the second insulative housing in a vertical direction perpendicular to both said transverse direction and said front-to-back direction to form a sub-assembly;

means for securing the first insulative housing and the second insulative housing together in the vertical direction to form a sub-assembly before a third insulative housing is applied upon said sub-assembly; wherein said means is located at both opposite front and rear ends of the sub-assembly.

10. The receptacle connector as claimed in claim 9, wherein said means includes a projection structure and a depression structure.

11. The receptacle connector as claimed in claim 9, wherein said means includes a pair of rib structures interlocked with each other.

12. The receptacle connector as claimed in claim 9, wherein said sub-assembly defines alignment means in the vertical direction including a bulge of one of the first insulative housing and the second insulative housing extending through an aperture of the shielding plate into a corresponding slot in the other of the first insulative housing and the second insulative housing.

13. The receptacle connector as claimed in claim 9, further includes an inner metallic collar shell assembled to the subassembly along the front-to-back direction.

14. The receptacle connector as claimed in claim 13, wherein said collar shell forms a plurality of through holes, and the sub-assembly forms a plurality of wedge projections received in the corresponding through holes, respectively.

15. A method of making a receptacle connector, comprising steps of:

forming a first terminal module via a first insert-molding process to have a plurality of first contacts integrally formed with a first insulative housing;

forming a second terminal module via a second insert-molding process to have a plurality of second contacts integrally formed with a second insulative housing;

forming a metallic shielding plate;

sandwiching the shielding plate between the first terminal module and the second terminal module;

providing means for securing the first insulative housing and the second insulative housing together in a vertical direction so as to have said first terminal module, said shielding plate and said second terminal module formed as a sub-assembly;

providing a third insulative housing overmolded upon the sub-assembly via a third insert-molding process to be integrally formed with the sub-assembly; wherein said means is located on both opposite front and rear ends of the sub-assembly in a front-to-back direction perpendicular to said vertical direction.

16. The method as claimed in claim 15, further including a step of assembling a metallic collar shell upon a root region of the sub-assembly along a front-to-back direction perpendicular to said vertical direction, and providing means for securing the collar shell and the sub-assembly together.

* * * * *